United States Patent [19]

Kaimann et al.

[11] 4,057,400

[45] Nov. 8, 1977

[54] APPARATUS FOR THE GASIFICATION UNDER PRESSURE OF BITUMINOUS COAL ESPECIALLY OF FINE COAL IN A GENERATOR

[76] Inventors: Walter Kaimann, Pollerbecks Brink 40, D-4300 Essen; Rudolf Pasternak, Lubecker Str. 15, D-4390 Gladbeck; Jochen Bauer, Rosastr. 61, D-4300 Essen, all of Germany

[21] Appl. No.: 720,984

[22] Filed: Sept. 7, 1976

[30] Foreign Application Priority Data

Sept. 9, 1975 Germany ..... 2540151

[51] Int. Cl.[2] ..... C10J 3/30

[52] U.S. Cl. ..... 48/77; 48/86 R; 48/101; 202/118; 214/17 C

[58] Field of Search ..... 48/86 R, 77, 76, 101, 48/210; 201/6, 22, 24; 202/118; 214/17 B, 17 C; 222/194, 410

[56] References Cited

U.S. PATENT DOCUMENTS

| | | | |
|---|---|---|---|
| 749,302 | 1/1904 | Koneman | 48/86 R |
| 3,756,434 | 9/1973 | Teske | 214/17 B |

FOREIGN PATENT DOCUMENTS

| | | | |
|---|---|---|---|
| 988,301 | 4/1976 | Canada | 44/10 C |
| 555,164 | 6/1932 | Germany | 201/6 |
| 262,901 | 12/1926 | United Kingdom | 214/17 B |

*Primary Examiner*—Robert L. Lindsay, Jr.
*Assistant Examiner*—George C. Yeung
*Attorney, Agent, or Firm*—Malcolm W. Fraser

[57] ABSTRACT

Apparatus for the gasification under pressure of bituminous coal, especially fine coal, comprising a generator which has a container to receive the coal to be gasified and a feed device which supplies the coal to the container, while keeping the container closed off so as to maintain the pressure in the generator. The feed device includes a device for agglomerating the coal to be gasified located on the container, and a continuously operable screw conveyor which feeds the coal to be gasified to the agglomerating device which delivers the formed agglomerates, in a green condition, into the container. The feed device is encapsulated and, together with the fine coal and agglomerates within it, forms a gas tight closure for the container to maintain the pressure therein.

1 Claim, 2 Drawing Figures

APPARATUS FOR THE GASIFICATION UNDER PRESSURE OF BITUMINOUS COAL ESPECIALLY OF FINE COAL IN A GENERATOR

BACKGROUND OF THE INVENTION

The invention relates to an apparatus for the gasification of bituminous coal, especially fine coal, comprising a generator which has a container to receive the coal to be gasified, and a feed device which supplies the coal to the container, while keeping the generator closed off so as to maintain the pressure in the generator.

The gasification of bituminous coal under pressure is known per se. Generally it is carried out in so-called generators of which various types of construction are known. In principle, however, all generators feature a container in which the exothermic reactions of the coal to be gasified take place. The slag and ash are drawn off at the lower end of the container while coal is fed to the container at its upper end. Various forms of feed device including gas tight closing-off of the generator are known, as well as a distributor arranged below the feed device to ensure an even loading of the container.

Designs of these so-called fixed bed generators are especially known in which the coal is fed to the container by way of a sluice. The sluice has upper and lower gas tight closures which can be operated either hydraulically or pneumatically.

When the upper closure is open the sluice is not pressurised and the coal to be gasified is fed into the sluice from a supply hopper situated above it. After filling, the upper closure is closed and the sluice is put under pressure from pressurised gas. Only after the sluice has been put under pressure is the lower closure opened so that the coal to be gasified finds its way into the container. The lower closure is then reclosed and the empty sluice is depressurised. The gas released is collected in a gas container which is, in turn, sealed off. The gas so collected can be mixed with the gas generated.

The sluice performs a non-continuous loading of the coal to be gasified. This results in sluice gas losses. Besides this, feeding of the container becomes technically complicated because of the non-continuity of the loading.

In general finely divided coal is gasified, being a mixture of material prepared from general mine coal with a granular size of from 0–30 mm. Fine coal, however, cannot be fed directly into the container of the generator with this range of granular sizes because grain sizes of 0–2 mm interfere with the draught in the body and lead to a high dust incidence in the gas produced. For this reason the fine coal is graded so that material of a granular size of 2–30 mm is fed to the container. In practice, however, according to the quality of the grading and the amount of granular breakdown involved by it, a more or less large proportion of undersize material is present in the fed material.

This method of operating has the disadvantage that it excludes in practice the predominant amount of general mine coal from pressure gasification because investigations have shown that about 70% of general mine coal after preparation comes in granular size of under 2 mm. Furthermore, the grading of such large amounts of coal occasions a considerable expense which can considerably prejudice the economics of pressure gasification.

Of course various processes for the aggregation of fine coal are known.

The conventional process for making briquettes does not have a place in the present invention, on the one hand because it pre-supposes a coal which is dried and which has a maximum grain size of 8–10 mm. Also, conventional briquette processes working with binders, such as bituminous pitch, and also processes working without binders, i.e. hot briquetting processes, require a cooling step following the moulding step, since only then is the required firmness of the briquette produced. The briquette forming process is also expensive.

Pelletising, which is also known, represents a considerable expense also. The agglomerates produced, which begin with nucleus grains occurring in the fed coal and which are built up by the continuous adhesion of fine grains, are known as green pellets. They posses a very low firmness. For this reason the green pellets have to undergo further treatment to render them firmer.

SUMMARY OF THE INVENTION

The object of the invention is to obviate the non-continuous feeding of the coal to be gasified by means of the feed device and also to render the undersize coal of 0–2 mm suitable for use in a fixed bed generator.

According to the invention there is provided apparatus for the gasification under pressure of bituminous coal, especially fine coal, comprising a generator which includes a container to receive the coal to be gasified and a feed device which supplies the coal to the container; which feed device includes a device for agglomerating the coal to be gasified, means locating the agglomerating device on the container to form a substantially gas tight enclosure therefor, continuously operable means to feed the coal to be gasified to the agglomerating device, and means to deliver the formed agglomerates, in a green condition, from the agglomerating device and into the container.

In one form of apparatus according to the invention, fine coal of 0–30 mm grain size, or, following preparation, of 2–30 mm grain size, (in any case low grain size coal from faulty extractions and coal exhibiting delayed friability) is charged into the agglomerating device preferably together with a binder such as tar, coal pitch, or sulphite liquor.

The agglomerates produced by the device are thus of a very low consistency. The firmness produced in the agglomerates is, however, suprisingly enough sufficient to avoid premature disintegration in the generator container which might otherwise lead to blocking. In particular these agglomerates are gas permeable.

Although the processes taking place in the container have not yet been sufficiently clarified, the possibility exists that the agglomerates first become firmer in the process heat of the generator, especially if by the carbonisation of the binder a firm skeleton is first formed before the agglomerates are burned.

Loading of the agglomerates into the container takes place immediately after they are formed. Thus the normally required after-treatment for consolidating the agglomerates is obviated. Furthermore, the load of fine coal passing to the agglomerating device, together with the agglomerates leaving the device, and the device itself, block the escape of gas from the container resulting in substantially gas tight closure of the generator, (if the unavoidable but in practice easily handled small leakages are not taken into account). In this manner there is provided not only continuous loading of the coal in the form of agglomerates but also processing heat can easily be led from the generator and used for the formation and after-treatment of the agglomerates.

The agglomerating device can be formed from a pelletisation device whose fed material consists of fine coal and a binder and which, starting from a drop of binder as well as the nucleus of the pellet formed by it, builds up the agglomerate. The binding forces of the pellet then consist of capillary forces, and also, in so far as the binder has adhesive properties, of such adhesive forces on the fed material.

A pug mill has proved itself, however, to be especially suitable as an agglomerating device. The grinding face of a pug mill features apertures for the shaping of agglomerates of fine coal and a binder, the mouths of which apertures are located above the container of the generator. These agglomerates differ from the pellets purely externally by their shape: While in general the pellets are ball shaped the agglomerates made in a pug mill way are cylinder shaped. These agglomerates are also more voluminous and in the green state have a greater firmness than the pellets.

DESCRIPTION OF THE PREFERRED EMBODIMENT

Figure 1:
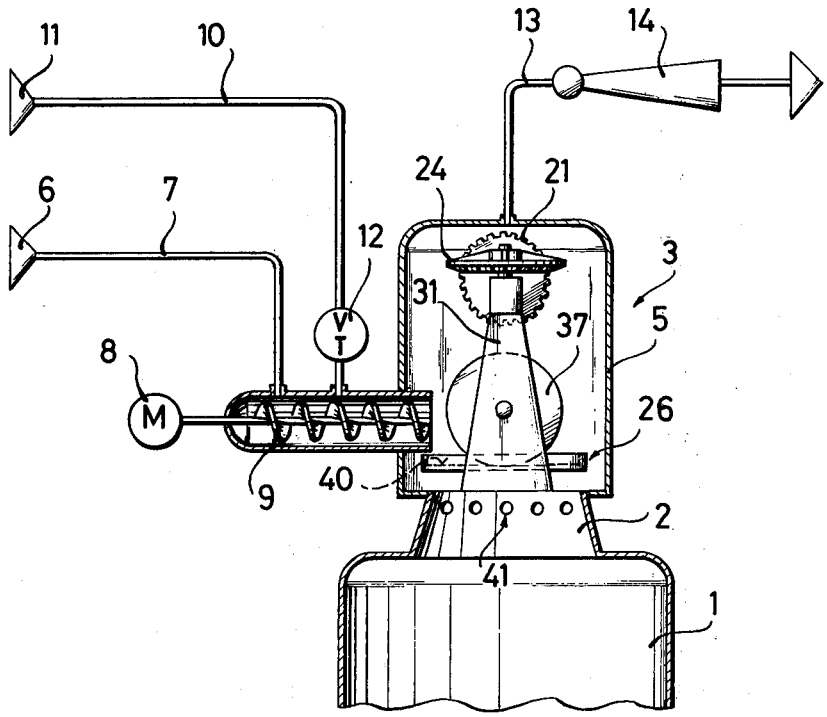
FIG. 1 is a schematic view representing an agglomerate forming device and its relationship to a fixed bed generator according to the invention.

The fixed bed generator comprises a container 1, under gas pressure, whose upper gas tight closure 2 carries a device 3, consisting of a pug mill, for the formation of agglomerates. This device is fed with finely divided coal from a bunker 6. The coal is fed by a conveyor 7 to a transporter, which in the embodiment illustrated consists of a screw conveyor 9, its casing, and drive motor 8.

Binder is fed into the casing of the screw conveyor through a line 10, for example from a tar separator 11 coupled to the generator. The binder is mixed with fine coal by the screw conveyor 8, 9. For controlling the amounts of binder supplied a metering device 12 is inserted in the line 10.

A line 13 is connected to a casing 5 which encapsulates in a gas tight manner the screw conveyor 9 and the device 3 for the production of the agglomerates. The line 13 leads to an ejector 14 which draws off any gas resulting from leakages. The entire assembly within the casing 5, together with the coal being fed by the screw conveyor, seal the container 1 off gas tight. The agglomerates are fed directly into the container 1.

Figure 2:
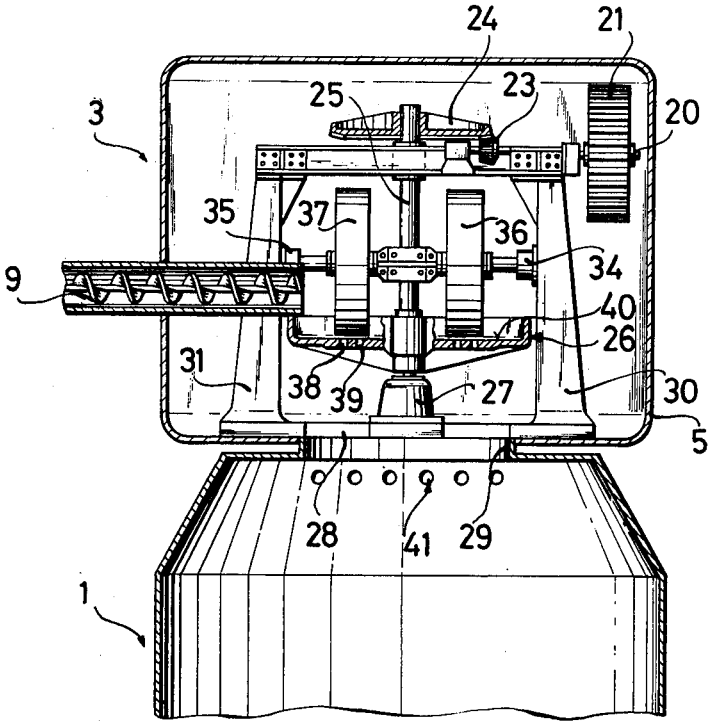
FIG. 2 is a detail of FIG. 1, namely a pug mill for forming the agglomerates.

In the illustrated embodiment the pug mill, generally designated by 3, serves for the agglomeration of the coal. The pug mill, as best seen in FIG. 2 has a driving shaft 20 with a drive wheel 21 and a driving pinion 23, which drives a relatively large diameter crown wheel 24. A shaft 25 is driven by the crown wheel and, in turn, drives a grinding face 26 which is attached to the lower end of the shaft 25. The lower end of the shaft 25 is carried in a bearing 27 which is mounted on a transom 28 over the opening 29 at the upper end of the container 1.

The transom is attached to the machine frame which consists of two pillars 30 and 31. The machine frame features bearings 34 and 35 for two rollers which are designated by 36 and 37.

The grinding face 26 has two concentric rows of apertures 38 and 39 respectively, which apertures are cylindrically shaped.

The screw conveyor 9 delivers fine coal, with the binder added and thoroughly mixed, onto the upper surface 40 of the grinding face 26. Carried by the rotation of the grinding face 26 the loaded material comes beneath the rollers 36 and 37 which squeeze it through the apertures 38 and 39 in the grinding face. The apertures lie directly above the container 1 and have their mouths above the opening 29. Thus the agglomerates, in a still green condition, fall into the container 1.

The distribution device operating with the feed device is generally designated by 41.

What we claim is:

1. Apparatus for the gasification under pressure of fine bituminous coal, comprising a. a generator having a coal-receiving container provided with an inlet opening to receive coal to be gasified, b. a gas tight casing on said inlet opening, c. a pelletizing device in said casing above said inlet opening and including a driven rotary apertured grinding face and roller means cooperating therewith to squeeze fine coal through the apertures to form pellets to feed directly through said inlet opening, d. a pressure tight conveyor housing connected to said casing for delivering fine coal to said grinding face, e. a conveyor in said housing, and f. separate means for feeding fine coal and a binder to said conveyor housing.

* * * * *